US008839801B2

(12) United States Patent
Miyazawa et al.

(10) Patent No.: US 8,839,801 B2
(45) Date of Patent: Sep. 23, 2014

(54) METHOD OF MANUFACTURING CIGARETTES

(75) Inventors: Shuichi Miyazawa, Tokyo (JP); Mitsuharu Sugyo, Tokyo (JP); Takanori Yagashira, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 160 days.

(21) Appl. No.: 13/358,731

(22) Filed: Jan. 26, 2012

(65) Prior Publication Data

US 2012/0279509 A1 Nov. 8, 2012

Related U.S. Application Data

(63) Continuation of application No. PCT/JP2010/061383, filed on Jul. 5, 2010.

(30) Foreign Application Priority Data

Jul. 27, 2009 (JP) ..... 2009-174394

(51) Int. Cl.

| | |
|---|---|
| ***A24B 3/14*** | (2006.01) |
| ***A24B 15/12*** | (2006.01) |
| ***A24B 15/24*** | (2006.01) |
| ***A24B 15/30*** | (2006.01) |

(52) U.S. Cl.

CPC . *A24B 3/14* (2013.01); *A24B 15/12* (2013.01); *A24B 15/24* (2013.01); *A24B 15/302* (2013.01)

USPC ..... 131/370; 131/353; 131/297; 131/300

(58) Field of Classification Search

USPC ..... 131/353, 370, 297, 300, 290, 364

See application file for complete search history.

(56) References Cited

U.S. PATENT DOCUMENTS

| | | | | |
|---|---|---|---|---|
| 4,941,484 | A | 7/1990 | Clapp et al. | |
| 5,065,775 | A | 11/1991 | Fagg | |
| 5,439,011 | A * | 8/1995 | Schneider | 131/360 |
| 2006/0021626 | A1 | 2/2006 | Mua | |

FOREIGN PATENT DOCUMENTS

| | | | |
|---|---|---|---|
| CN | 1565284 | A | 1/2005 |
| CN | 101268857 | A | 9/2008 |
| GB | 2460499 | A | 12/2009 |
| JP | 3-10667 | A | 1/1991 |
| JP | 5-7485 | A | 1/1993 |
| JP | 2006-180715 | A | 7/2006 |
| JP | 2008-507978 | A | 3/2008 |
| WO | WO 2004/107885 | A1 | 12/2004 |
| WO | WO 2007/032433 | A1 | 3/2007 |

OTHER PUBLICATIONS

International Preliminary Report on Patentability, completed on Jun. 2, 2011, issued in PCT/JP2010/061383.

International Search Report, dated Sep. 21, 2010, issued in PCT/JP2010/061383.

* cited by examiner

*Primary Examiner* — Richard Crispino

*Assistant Examiner* — Dionne Walls Mayes

(74) *Attorney, Agent, or Firm* — Birch, Stewart, Kolasch & Birch, LLP

(57) ABSTRACT

Method of manufacturing a cigarette having equivalent aroma and flavor even with a reduced amount of burley leaves. The method does not require special processing treatment due to the absence of necessity of an installation space and costs for the treatment. Also, method of manufacturing a cigarette containing the same, and a cigarette. The invention separates raw material for sheet tobacco into fiber and solution, adds a primary casing flavor to the solution, mixes the solution added with the primary casing flavor and the fiber to produce a mixture, and dries the mixture. Burley leaf tobacco is thereafter mixed with the sheet tobacco. The casing flavor is previously added at the time of the molding of sheet tobacco in the sheet-tobacco manufacturing process, which makes enables production of sheet tobacco having the aroma and flavor equivalent of when burley leaf tobacco is used, even without special processing treatment.

1 Claim, 6 Drawing Sheets

FIG. 3

| CONVENTIONAL ART | PRESENT INVENTION | | |
|---|---|---|---|
| | SHEET TOBACCO | BURLEY LEAF TOBACCO | SECONDARY CASING |
| BURLEY LEAF TOBACCO SUBJECTED TO SPECIAL PROCESSING TREATMENT | | | |
| ODOR PROPERTY ☆☆☆☆☆ | ☆ | ☆ | ☆☆☆ |
| TASTE PROPERTY ☆☆☆☆☆ | ☆☆☆ | | ☆☆ |
| SMOKE PROPERTY ☆☆☆☆☆ | ☆ | ☆☆☆ | ☆ |

FIG. 5

| AROMA MATERIAL A (AQUEOUS PLANT EXTRACT) | | CONTENT | | |
|---|---|---|---|---|
| | | 8% | 10% | 12% |
| SUGAR CONCEN-TRATION | 25% | 3.0 | 4.0 | 4.5 |
| | 30% | 3.5 | 5.0 | 5.5 |
| | 35% | 4.5 | 5.5 | 7.0 |

FIG. 6

| AROMA MATERIAL B (SPRAY-DRIED AROMA POWDER) | CONTENT | | |
|---|---|---|---|
| | 3% | 5% | 7% |
| | 2.0 | 5.0 | 7.0 |

FIG. 7

| | (A) BURLEY LEAF TOBACCO SUBJECTED TO SPECIAL PROCESSING TREATMENT | (B) SHEET TOBACCO ONLY | (C) SHEET TOBACCO AND BURLEY LEAF TOBACCO (WITHOUT SECONDARY CASING) | (D) SHEET TOBACCO AND BURLEY LEAF TOBACCO (WITH SECONDARY CASING) |
|---|---|---|---|---|
| ODOR | 5.0 | 2.3 | 2.8 | 4.3 |
| TASTE | 5.0 | 2.8 | 3.2 | 4.6 |
| SMOKE | 5.0 | 2.2 | 3.9 | 4.8 |

METHOD OF MANUFACTURING CIGARETTES

This application is a Continuation of PCT/JP2010/061383 filed on Jul. 5, 2010, which claims priority under 35 U.S.C. §119(a) to Patent Application No. 2009-174394 filed in Japan on Jul. 27, 2009, all which are hereby incorporated by reference into the present application.

TECHNICAL FIELD

The present invention relates to a method of manufacturing sheet tobacco, a method of manufacturing cigarettes containing the same, and a cigarette.

BACKGROUND ART

Many of the cigarettes currently distributed in the marketplace are manufactured by method called an "American Blend" method. This manufacturing method adds a large quantity of casing flavor to burley leaves as raw material, dries the leaves with a multiple-chamber dryer, and blends them with other raw materials. The process of adding the casing flavor to burley leaves and the subsequent drying process are called special processing treatment, which creates distinctive sweet odor and taste. The sweet odor and taste serve as chief aroma and flavor of "American Blend-type" cigarettes.

The special processing treatment, however, requires fairly large-scale equipment including the multiple-chamber dryer used for the drying process. The setup of an installation space and a large equipment investment are therefore necessary. The special processing treatment also requires high running costs. In addition, tobacco factories with no equipment for the special processing treatment have to entrust the treatment to other tobacco factories, leading to a deterioration in productivity.

International Publication WO 2004/107885 discloses a tobacco mixture having a reduced percentage of nitrosamine (TSNA) that is contained in leaf tobacco using burley leaves, and also discloses a cigarette containing this mixture. The tobacco mixture and the cigarette (leaf tobacco) containing this mixture are for producing American Blend-type leaf tobacco by preparing an absorbing agent for absorbing TSNA, and using 50 percent or more of the reconstituted tobacco flakes previously contacted to the absorbing agent. In result, leaf tobacco containing reduced TSNA is supposed be produced. However, since International Publication WO 2004/107885 adopts the American Blend method for manufacturing leaf tobacco, the special processing treatment is applied to manufacture the leaf tobacco. There still remains the problem that the special processing treatment is required.

SUMMARY OF THE INVENTION

Problems to be Solved by the Invention

It is an object of the present invention to provide a method of manufacturing sheet tobacco for producing a cigarette that does not require a special processing treatment because of reduced use of burley leaves, reduces an installation space and costs for the treatment, and has aroma and flavor equivalent of those of a cigarette in which the amount of burley leaves to be used is not reduced, as compared to the conventional art, a method of manufacturing a cigarette containing the same, and a cigarette.

Means for Solving the Problem

To achieve the object, the invention provides a method of manufacturing sheet tobacco, which is characterized by the steps of separating raw material for sheet tobacco into fiber and solution, adding a casing flavor to the solution, mixing the solution added with the casing flavor and the fiber to produce a mixture; drying the mixture to produce sheet tobacco; adjusting the sheet tobacco and burley leaf tobacco in moisture content; adding a casing flavor for a secondary casing treatment, which differs from the casing flavor, to the sheet and burley leaf tobaccos adjusted in moisture content; adding a cased leaf tobacco of a different kind from the sheet tobacco and the burley leaf tobacco to produce cut tobacco; and wrapping the cut tobacco or a mixture of the cut tobacco in wrapping paper.

The invention further provides a cigarette characterized by being manufactured by the cigarette manufacturing method.

Technical Advantage of the Invention

According to the present invention, treatment equivalent of the special processing treatment to be applied to burley leaves (drying the burley leaves after adding a casing flavor to the leaves) is carried out in the sheet-tobacco manufacturing process. It is therefore possible to obtain sheet tobacco with a smoky sweet flavor that is created when burley leaf tobacco undergoes a special processing treatment.

According further to the present invention, the sheet tobacco with a smoky sweet flavor and the burley leaf tobacco are adjusted in moisture content, and a casing flavor for a secondary casing treatment is added thereto, thereby manufacturing cigarettes. Cigarettes with a sufficient smoky sweet flavor are thus manufactured with a less amount of burley leaf tobacco as compared to conventional cigarettes. On this account, cigarettes using burley leaf tobacco can be manufactured without performing the conventional special processing treatment of adding a casing flavor to burley leaf tobacco and drying the same. This eliminates the necessity of the installation space for the special processing treatment and enables cigarettes to be manufactured cost-effectively.

According also to the present invention, it is possible to produce American Blend-type cigarettes with a sufficient smoky sweet flavor.

BRIEF DESCRIPTION OF THE DRAWINGS

FIG. 3 is a table for comparing the aroma and flavor of a conventional American Blend-type cigarette to those of a cigarette of the invention;

FIG. 5 is a table showing evaluation results indicative of relationship between the content of an aqueous plant extract and sugar concentration;

FIG. 6 is a table showing evaluation results obtained when the content of spray-dried aroma powder is varied; and FIG. 7 is a table for a comparison of aromas and flavors of cigarettes of various kinds.

BEST MODE FOR CARRYING OUT THE INVENTION

Figure 1:
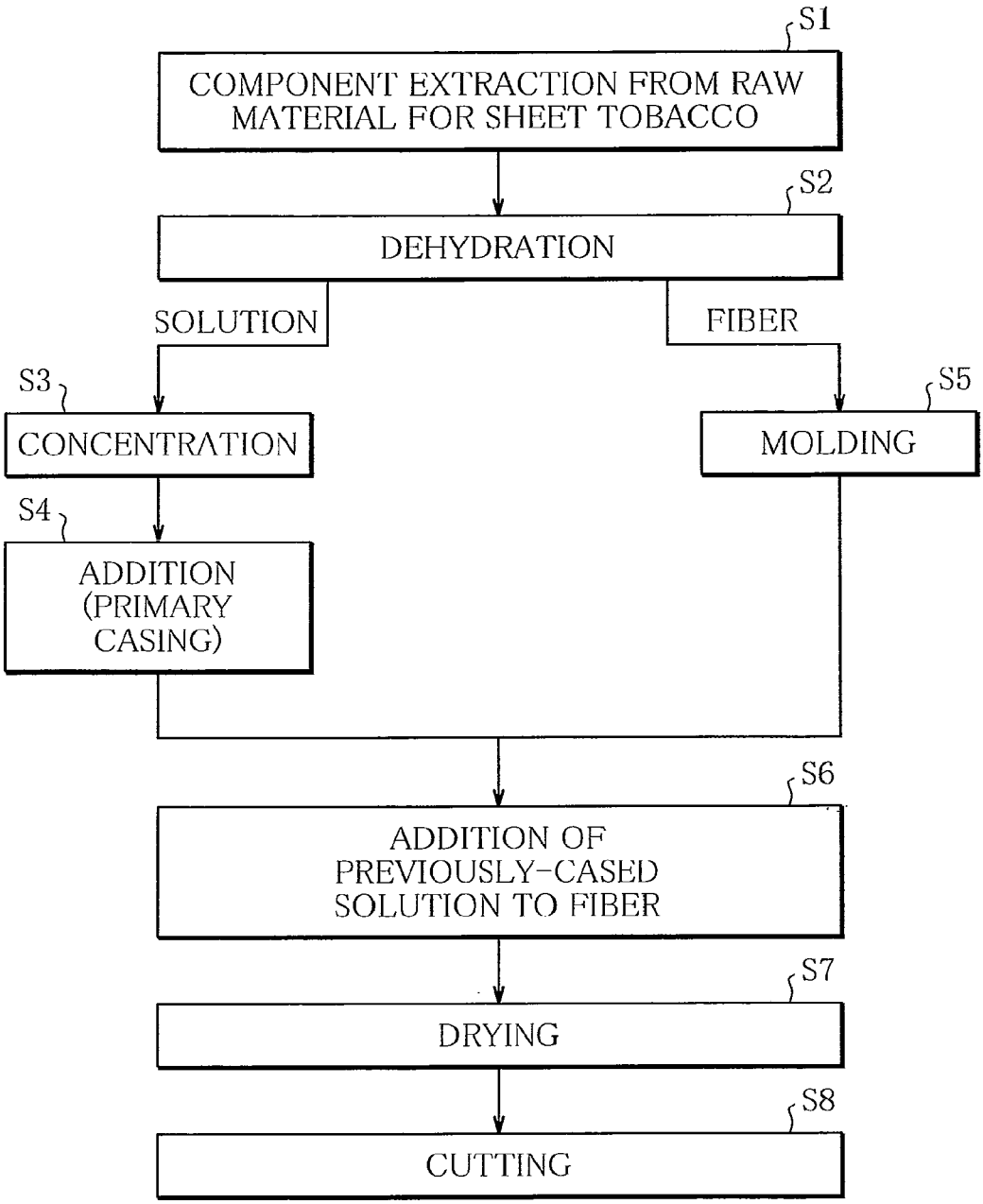
FIG. 1 is a flowchart showing a sheet-tobacco manufacturing method according to the invention.
Figure 2:
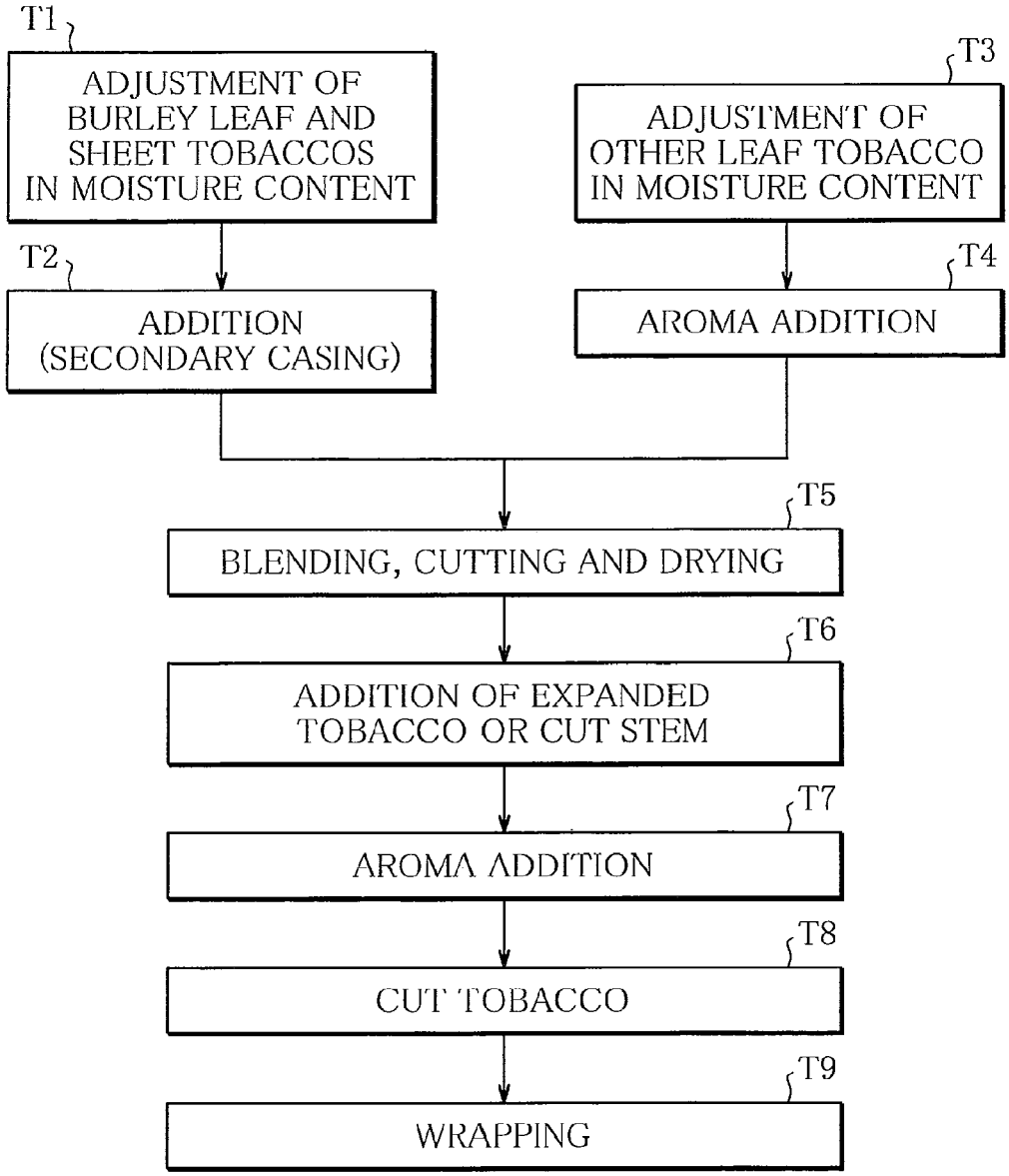
FIG. 2 is a flowchart showing a cigarette manufacturing method according to the invention.

FIG. 1 is a flowchart showing a sheet-tobacco manufacturing method according to the invention. FIG. 2 is a flowchart showing a cigarette manufacturing method according to the invention.

The cigarette according to the invention uses a less amount of burley leaf tobacco than conventional cigarettes, and yet has aroma and flavor equivalent of those of the conventional ones. The reduction of burley leaf tobacco eliminates the necessity of a process of adding a casing flavor to the burley leaf tobacco and a drying process (special processing treatment) which have been performed in conventional art, and also eliminates the necessity of equipment therefor. This enables cigarettes to be manufactured with efficiency in terms of space and cost. A method of manufacturing the same will be described below.

First, the sheet-tobacco manufacturing method will be described below with reference to FIG. 1.

Components are extracted from raw material for sheet tobacco (Step S1). The raw material for sheet tobacco includes fine tobacco powder, reinforcing agent, stems, scraps, etc.

The extract is dehydrated by being pressed with a pressing machine or the like. The extract is thus separated into fiber and solution (Step S2). This is called a separation process.

The solution is then concentrated (Step S3).

The solution concentrated in Step S3 is subjected to a primary casing treatment (Step S4). The primary casing treatment adds a casing flavor to the solution filled in the tank. The casing flavor is one contributing to a taste property serving as a cigarette taste. For example, the casing flavor is an aqueous plant extract, coffee, alfalfa, honey or the like with a sugar concentration of 30 percent or more. The casing flavor may also be spray-dried aroma powder. For example, carob beans, granulated sugar, licorice, cacao or the like may be used. Glycerin serving as a moisturizing agent is also added into the tank.

Secondly, the fiber is molded (Step S5). In this molding process, a fiber/water mixture is subjected to a dehydration/drying treatment and is molded into a sheet at the same time.

The molded fiber is added with the solution that has undergone the primary casing treatment in Step S4 (Step S6).

The sheet-like fiber/solution mixture is dried (Step S7). A hot-air tunnel dryer is used for the drying.

The sheet-like fiber that has been dried is cut into desired size (Step S8). For example, the fiber is cut into 50×50 mm squares. In result, sheet tobacco that has undergone the primary casing treatment in advance is produced.

A cigarette-manufacturing method will be described below with reference to FIG. 2.

Burley leaf tobacco and sheet tobacco are adjusted in moisture content (Step T1). The sheet tobacco is mixed with the burley leaf tobacco, so that the amount of burley leaves to be used is reduced less than ever before.

The burley leaf and sheet tobaccos of Step T1 are subjected to a secondary casing treatment (Step T2). A casing flavor used in this treatment is one for the secondary casing treatment, such as plant extract (food flavor and tobacco flavor). The casing flavor for the secondary casing treatment is one that mainly provides fragrance (casing flavor that is reinforced in an odor property). If the casing flavor that mainly provides the taste property is used in the sheet-tobacco manufacturing process, and the casing flavor that mainly provides the odor property is added when cigarettes are actually manufactured with a mixture of the sheet and burley leaf tobaccos as described above, the following effects are expected.

Since the casing flavor adding process is divided into the primary casing treatment and the secondary casing treatment, and the primary casing treatment is carried out in the sheet-tobacco manufacturing process, there is no need for the special processing treatment in which a multiple-chamber dryer is centrally operated by American Blend-type method using conventional burley leaf tobacco only. During the storage of the sheet tobacco, aroma does not evaporate because the casing flavor for the odor property is actually provided to the sheet tobacco through the secondary casing treatment at the cigarette manufacturing stage.

Other leaf tobacco is separately adjusted in moisture content, and a mixture is fabricated (Step T3).

The other leaf tobacco adjusted in moisture content, which has been obtained in Step T3, is added with an aqueous casing flavor (Step T4). The casing flavor used in this step differs from the one used in the secondary casing treatment in Step T2.

The cased leaf tobaccos obtained in Steps T2 and T4 are blended together, cut, and dried (Step T5).

Expanded tobacco or cut stem are added therein if desired (Step T6).

The mixture obtained up to Step T6 is added with aroma (Step T7). This is the final addition of aroma.

The resultant obtained in Step T7 is formed into cut tobacco (Step T8).

The cut tobacco obtained in Step T8 is wrapped in wrapping paper, and cigarettes are thus manufactured (Step T9). In other words, the cigarette manufacturing method of the invention is a combination of the flowcharts shown in FIGS. 1 and 2.

FIG. 3 is a table for comparing the aroma and flavor of a conventional American Blend-type cigarette to those of a cigarette of the invention.

The comparison was made in terms of odor, taste, and smoke properties of the aromas and flavors of these cigarettes. As the comparison was based upon the conventional American Blend-type cigarette, the odor, taste and smoke properties of the aroma and flavor of the conventional American Blend-type cigarette are each indicated by five stars.

According to the invention, the sheet tobacco mainly provides the taste property in the primary casing treatment, so that it was given three stars in the taste property, and one star each in the odor and the smoke property. It was found that the aroma and flavor of the conventional American Blend-type cigarette could not be materialized solely with the sheet tobacco. Meanwhile, the burley leaf tobacco was given one star in the odor property and three in the smoke property. The casing flavor used in the secondary casing treatment mainly provides the odor property to the sheet tobacco and the burley leaf tobacco. This casing flavor was therefore given three stars in the odor property, two in the taste property, and one in the smoke property. The sum of the numbers of the stars given to the sheet tobacco (that has been already subjected to the primary casing treatment), the burley leaf tobacco, and the leaf tobacco that has undergone the secondary casing treatment is five in each property. This is the same number of the stars as the conventional American Blend-type cigarette. This means that the cigarette manufacturing method of the invention makes it possible to create the aroma and flavor equivalent of those of the conventional American Blend-type cigarette.

Figure 4:
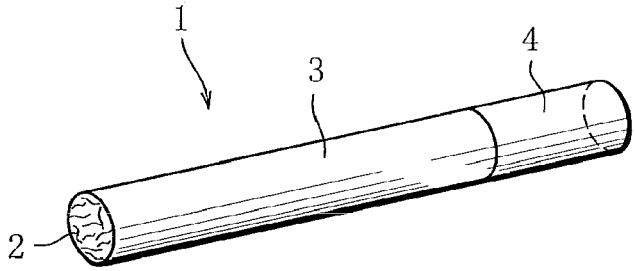
FIG. 4 is a schematic view of a cigarette according to the invention.

FIG. 4 is a schematic view of a cigarette according to the invention.

As shown in the drawing, a cigarette 1 of the invention is fabricated by wrapping cut tobacco 2 in wrapping paper 3. The cut tobacco 2 is obtained in Step T8. To be specific, the cut tobacco 2 is obtained by mixing the sheet tobacco produced by the sheet-tobacco manufacturing method of the invention and the burley leaf tobacco, and then subjecting the mixture to the secondary casing treatment. As mentioned above, the casing flavor that is added in the sheet-tobacco manufacturing process has a smoky sweet flavor. Reference mark 4 represents a filter.

For the above reasons, the aroma and flavor equivalent of those of the conventional American Blend-type cigarette can be obtained. Furthermore, the cigarette produced by the manufacturing method of the invention uses a less amount of burley leaf tobacco than the conventional cigarette. This eliminates the necessity of the special processing treatment for developing the distinguish aroma and flavor of burley leaf tobacco. Instead of applying the special processing treatment, the sheet tobacco with the smoky sweet flavor, which has undergone the primary casing treatment, is used to develop the aroma and flavor. Moreover, cigarettes containing a large quantity of burley leaf tobacco are not comfortable to smoke. The cigarette of the invention contains a reduced amount of burley leaf tobacco, and is therefore more comfortable to smoke.

FIG. 5 is a table showing evaluation results indicative of relationship between content and sugar concentration of an aqueous plant extract.

As shown in the table, an aqueous plant extract is used as aroma material A contained in the casing flavor used for the sheet tobacco of the invention. The content and the sugar concentration are varied to evaluate the smoky sweet flavor. Each result is shown with a score. For example, the score is 3.0 when the content of the aroma material is 8 percent by weight, and the sugar concentration is 25 percent. When the content is 10 percent by weight, and the sugar concentration is 30 percent, the score is 5.0. These scores indicate whether the aroma material has a target smoky sweet flavor. In this specification, a score of 5.0 is the minimum necessary score for the smoky sweet flavor required in the invention. If the score is 5.0 or more, this means that the aroma material has much smoky sweet flavor as the target is achieved. On this account, in the cases where the content is 10 percent by weight or more, and the sugar concentration is 30 percent or more, the scores are 5.0 or more. Accordingly, if the aqueous plant extract is used as the aroma material, it is necessary that the content should be 10 percent by weight or more, and that the sugar concentration should be 30 percent or more.

FIG. 6 is a table showing evaluation results obtained when the content of spray-dried aroma powder is varied.

As shown in the table, spray-dried aroma powder is used as aroma material B, and is varied in content to evaluate the smoky sweet flavor. When there is a content of 5 percent by weight or more, the score reaches 5.0 or more. It is apparent that there is a sufficient smoky sweet flavor when the content is 5 percent by weight or more. Accordingly, if the spray-dried aroma powder is used as the aroma material, it is necessary that the content should be 5 percent by weight or more. The other evaluation criteria are as described above with reference to FIG. 5.

The inventors further made a comparison between various kinds of cigarettes in terms of aroma and flavor. The result is shown in FIG. 7. The cigarettes compared were cigarette (A) using burley leaf tobacco subjected to the conventional special processing treatment; cigarette (B) using sheet tobacco only; cigarette (C) fabricated by mixing sheet tobacco and burley leaf tobacco, and subjecting the mixture not to the secondary casing treatment but to common treatment; and cigarette (D) according to the invention, which is fabricated by mixing sheet tobacco and burley leaf tobacco, and subjecting the mixture not only to the common treatment but also to the secondary casing treatment. Evaluation values of the odor, taste, and smoke properties of the cigarette (A) were each set at 5.0. Based upon these values as criteria, the cigarettes (B) to (D) were evaluated.

The evaluation was started by having a plurality of raters taste the cigarette (A). The evaluation values given by the raters were decided to be 5.0 as mentioned above. The raters then actually tasted the cigarettes (B) to (D) and scored the properties of the aroma and flavor with respect to each cigarette in increments of 0.5. An average value of each property was then calculated. The raters tasted the cigarettes (B) to (D) without being informed of what kinds these cigarettes were. The cigarette (B) using sheet tobacco only was scored 2.3 in respect of the odor property thereof. The taste property and the smoke property were 2.8 and 2.2, respectively. The cigarette (C) using the sheet and burley leaf tobaccos mixed and then subjected not to the secondary casing treatment but to the common treatment was scored 2.8 in respect of the odor property thereof. The taste property and the smoke property were 3.2 and 3.9, respectively. The cigarette (D) according to the invention was scored 4.3 in respect of the odor property thereof. The taste property and the smoke property were 4.6 and 4.8, respectively.

It is found from the foregoing result that the aroma and flavor of the cigarette (B) were quite different from those of the cigarette (A) using the conventional burley leaf tobacco, and that the cigarette (C) was a little more similar to the cigarette (A). Nevertheless, as compared to the cigarette (C), the cigarette (D) according to the invention has the aroma and flavor that are much closer to and almost equivalent of those of the cigarette W. Consequently, it can be said that the cigarette of the invention offers the aroma and flavor equivalent of those of the conventional American Blend-type cigarette.

The invention claimed is:

1. A method of manufacturing cigarettes, characterized by the steps of:

separating raw material for sheet tobacco into fiber and solution;

adding a primary casing flavor to the solution;

mixing the solution added with the primary casing flavor and the fiber to produce a mixture;

drying the mixture to produce sheet tobacco;

mixing the sheet tobacco with burley leaf tobacco;

adjusting the sheet tobacco and burley leaf tobacco in moisture content;

adding a secondary casing flavor for a secondary casing treatment, which differs from the primary casing flavor, to the sheet and burley leaf tobaccos adjusted in moisture content;

adding a cased leaf tobacco of a different kind from the sheet tobacco and the burley leaf tobacco to produce cut tobacco, and wrapping the cut tobacco or a mixture of the cut tobacco in wrapping paper.

* * * * *